US006637527B1

(12) United States Patent
Singh et al.

(10) Patent No.: US 6,637,527 B1
(45) Date of Patent: Oct. 28, 2003

(54) CUTTING STRUCTURE FOR ROLLER CONE DRILL BITS

(75) Inventors: Amardeep Singh, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 131 days.

(21) Appl. No.: 09/590,578

(22) Filed: Jun. 8, 2000

(51) Int. Cl.[7] ..... E21B 10/00
(52) U.S. Cl. ..... 175/355; 175/431
(58) Field of Search ..... 175/374, 360, 175/378, 398, 431, 353, 355, 361

(56) References Cited

U.S. PATENT DOCUMENTS

| | | | | | |
|---|---|---|---|---|---|
| 4,408,671 | A | | 10/1983 | Munson | |
| 4,611,673 | A | | 9/1986 | Childers et al. | |
| 4,657,093 | A | | 4/1987 | Schumacher | |
| 4,848,476 | A | | 7/1989 | Deane et al. | |
| 5,197,555 | A | * | 3/1993 | Estes | 175/431 |
| 5,201,376 | A | * | 4/1993 | Williams | 175/374 |
| 5,372,210 | A | | 12/1994 | Harrell | |
| 5,394,952 | A | | 3/1995 | Johns et al. | |
| 5,813,480 | A | | 9/1998 | Zaleski, Jr. et al. | |
| 5,839,526 | A | * | 11/1998 | Cineros et al. | 175/431 |
| 6,057,784 | A | | 5/2000 | Schaaf et al. | |
| 6,095,262 | A | | 8/2000 | Chen | |
| 6,105,694 | A | * | 8/2000 | Scott | 175/428 |
| 6,164,394 | A | * | 12/2000 | Mensa-Wilmot et al. | 175/331 |
| 6,213,225 | B1 | | 4/2001 | Chen | |
| 6,230,828 | B1 | * | 5/2001 | Beuershausen et al. | 175/431 |
| 6,401,839 | B1 | | 6/2002 | Chen | |
| 6,412,577 | B1 | | 7/2002 | Chen | |

FOREIGN PATENT DOCUMENTS

| | | | | |
|---|---|---|---|---|
| GB | 2 324 555 | | 10/1998 | |
| SU | 001719613 | * | 3/1992 | 175/431 |
| SU | 001724847 | * | 4/1992 | 175/431 |
| WO | WO 00/12859 | | 3/2000 | |
| WO | WO 00/12860 | | 3/2000 | |

OTHER PUBLICATIONS

Society of Petroleum Engineers Paper No. 29922, "the Computer Simulation of the Interaction Between Roller Bit and Rock", Dekun Ma, et al, presented Nov. 14–17, 1995, 9 pages.

Society of Petroleum Engineers Paper No. 56439, "Field Investigation of The Effects of Sticki–Slip, Lateral, and Whirl Vibrations on Roller Cone Bit Performance", S. L. Chen et al, presented Oct. 3–6, 1999, 10 pages.

Society of Petroleum Engineers Paper No. 71053, "Development and Application of a New Roller Cone Bit with Optimized Tooth Orientation", S.L. Chen et al., presented May 21–23, 2001, 15 pages.

Society of Petroleum Engineers Paper No. 71393, "Development and Field Applications of Roller Cone Bits with Balanced Cutting Structure", S.L. Chen et al., presented Sep. 30 –Oct. 3, 2001, 11 pages.

Ma Dekun, et al., "The Operational Mechanics of the Rock Bit", Petroleum Industry Press, 1996, pp. 1–243.

Great Britain Search Report dated Aug. 21, 2001, 4 pages.

* cited by examiner

*Primary Examiner*—Frank Tsay
(74) *Attorney, Agent, or Firm*—Rosenthal & Osha, L.L.P.

(57) ABSTRACT

The invention relates to a roller cone drill bit for drilling earth formations. The drill bit includes a bit body and a plurality of roller cones attached to the bit body and able to rotate with respect to the bit body. Each roller cone of the bit includes a truncated apex and a side surface. The drill bit further includes a plurality of cutting elements disposed on the side surface of each cone. The cutting elements on at least one cone are arranged such that at least one cutting element on that cone extends past an axis of rotation of the bit body as the bit is rotated. In one embodiment, the drill bit includes three cones and the cutting elements are arranged on the cones so that cutting elements on adjacent cones intermesh between the cones.

22 Claims, 8 Drawing Sheets

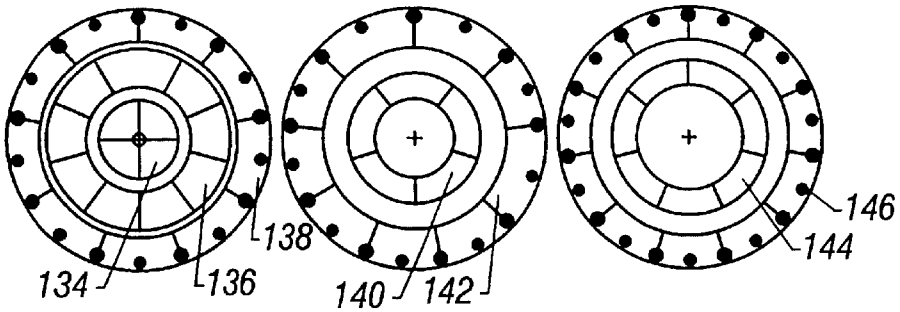

| | CONE | ROW | # TEETH | SPACING | INCLINATION ANGLE | TOOTH ANGLE | TOOTH WIDTH INNER END ② | TOOTH WIDTH OUTER END 3 | ROOT ANGLE | END MILL CUTTER ANGLE | END MILL CUTTER RADIUS | SPECIAL INSTRUCTIONS |
|---|---|---|---|---|---|---|---|---|---|---|---|---|
| 120 | | A | 4 | 4 | 19.49° | 40.00° | .06 | .06 | 16.69° | 120.00° | .125 R | SEE DIAGRAM FOR ORIENTATION |
| 122 | 1 | B | 9 | 19 | 31.89° | 43.00° | .09 | .09 | 18.33° | 75.00° | .250 R | ONE 1-1/2 P (SEE DIAGRAM FOR PLACEMENT) |
| 124 | | C | 9 | 18 | 11.99° | 43.00° | .14 | .14 | 10.53° | 62.50° | .125 R | DELETE EVERY OTHER TOOTH WITH 45° x .750 ED x .250 R CUTTER • 15.0° ROOT. MILL AXIS ⊥ TO TOOTH ROOT. STOP CUTTER PRIOR TO CONTACTING TEETH ON "B" ROW. |
| 126 | | A | 5 | 5 | 24.69° | 43.00° | .09 | .09 | 19.50° | 105.00° | .125 R | SEE DIAGRAM FOR ORIENTATION |
| 128 | 2 | B | 9 | 30 | 17.46° | 43.00° | .09 | .15 | 13.39° | 77.50° | .625 R / .375 R | THREE 1-1/3 P (SEE DIAGRAM FOR PLACEMENT) MILL FIRST PASS COMPLETELY THRU WITH .625 R CUTTER. MILL SECOND PASS WITH .375 R CUTTER AND STOP CUTTER PER PRINT. BLEND CUTS AS CLOSE AS POSSIBLE. |
| 130 | | A | 7 | 7 | 32.20° | 43.00° | .09 | .09 | 22.85° | 85.00° | .375 R | SEE DIAGRAM FOR ORIENTATION |
| 132 | 3 | B | 11 | 11 | 11.21° | 43.00° | .12 | .12 | 8.96° | 75.00° | .563 R / .250 R | MILL FIRST PASS COMPLETELY THRU WITH .563 R CUTTER. MILL SECOND PASS WITH .250 R CUTTER AND STOP CUTTER PER PRINT. BLEND CUTS AS CLOSE AS POSSIBLE. |

*FIG. 3C*
*(Prior Art)*

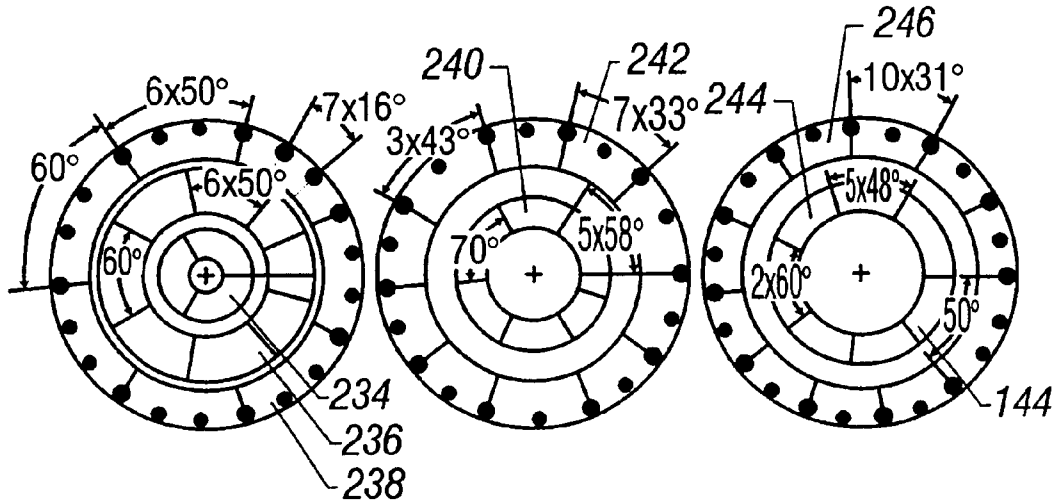

| | CONE | ROW | # TEETH | PITCH SPACING | TOOTH ANGLE | TOOTH WIDTH INNER END ② | TOOTH WIDTH OUTER END 3 | ROOT ANGLE | RADIUS | SPECIAL INSTRUCTIONS |
|---|---|---|---|---|---|---|---|---|---|---|
| 220 | | A | 3 | 3x120° | 43.00° | .09 | .09 | 16.69° | .125 R | SEE DIAGRAM FOR ORIENTATION |
| 222 | 1 | B | 7 | 6x50°;1x60° | 43.00° | .09 | .09 | 18.33° | .250 R | SEE DIAGRAM FOR ORIENTATION |
| 224 | | C | 7 | 6x50°;1x60° | 43.00° | .12 | .12 | 10.53° | .250 R | SEE DIAGRAM FOR ORIENTATION |
| 226 | | A | 6 | 5x58°;1x70° | 43.00° | .14 | .14 | 19.50° | .125 R | SEE DIAGRAM FOR ORIENTATION |
| 228 | 2 | B | 10 | 7x33°;3x43° | 43.00° | .12 | .12 | 13.39° | .188 R | SEE DIAGRAM FOR ORIENTATION |
| 230 | | A | 7 | 5x48°;2x60° | 43.00° | .09 | .09 | 22.85° | .188 R | SEE DIAGRAM FOR ORIENTATION |
| 232 | 3 | B | 11 | 10x31°;1x50° | 43.00° | .12 | .12 | 8.96° | .125 R | SEE DIAGRAM FOR ORIENTATION |

FIG. 6

CUTTING STRUCTURE FOR ROLLER CONE DRILL BITS

BACKGROUND OF THE INVENTION

1. Technical Field

The invention relates generally to roller cone drill bits for drilling earth formations, and more specifically to roller cone drill bit designs.

2. Background Art

Roller cone rock bits and fixed cutter bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a borehole 14. Connected to the end of the drill string 12 is a roller cone-type drill bit 20, shown in further detail in FIG. 2.

Referring to FIG. 2, roller cone drill bits 20 typically comprise a bit body 22 having an externally threaded connection at one end 24, and a plurality of roller cones 26 (usually three as shown) attached at the other end of the bit body 22. The cones 26 are able to rotate with respect to the bit body 22. Disposed on each of the cones 26 of the bit 20 is a plurality of cutting elements 28 typically arranged in rows about the surface of each cone 26.

The cutting elements 28 on a cone 26 may include primary cutting elements, gage cutting elements, and ridge cutting elements. Primary cutting elements are the cutting elements arranged on the surface of the cone such that they contact the bottomhole surface as the bit is rotated to cut through the formation. Gage cutting elements are the cutting elements arranged on the surface of the cone to scrape the side wall of the hole to maintain a desired diameter of the hole as the formation is drilled. Ridge cutting elements are miniature cutting elements typically located between primary cutting elements to cut formation ridges that may pass between the primary cutting elements to protect the cones and minimize wear on the cones due to contact with the formation. The cutting elements 28 may be tungsten carbide inserts, superhard inserts, such as polycrystalline diamond compacts, or milled steel teeth with or without hardface coating.

Typically, roller cone bits, especially bits with milled steel teeth, include one or more cutting elements arranged about the apex of at least one cone to cut through formation near the center of the bit. The cone apex having cutting elements arranged thereon is commonly referred to as a "spearpoint" of the bit. One example of a spearpoint on one cone of a roller cone drill bit is shown at 114*a* in FIG. 3A.

Some bits exist which do not include a spearpoint to cut formation near the center of the bit. These bits are commonly referred to as "coring bits" and are used for drilling a borehole with an uncut center (or core) within the hole. Coring bits differ from conventional roller cone bits in that coring bits are purposefully designed to form a core within in the borehole as the borehole is drilled. On the other hand, conventional roller cone bits are designed to drill the entire formation in the borehole, wherein formation near the center of the bit is drilled by the spearpoint of the bit, typically located at the apex of one cone.

Significant expense is involved in the design and manufacture of drill bits to produce bits which have increased drilling efficiency and longevity. For more simple bit designs, such as those for fixed cutter bits, models have been developed and used to design and analyze bit configurations which exhibit balanced forces on the individual cutting elements of the bit during drilling. Fixed cutter bits designed using these models have been shown to provide faster penetration and long life.

Roller cone bits are more complex than fixed cutter bits, in that the cutting surfaces of the bit are disposed on roller cones, wherein each roller cone independently rotates relative to the rotation of the bit body about an axis oblique to the axis of the bit body. Because the cones rotate independently of each other, the rotational speed of each cone of the bit is likely different from the rotation speed of the other cones. The rotation speed for each cone of a bit can be determined from the rotational speed of the bit and the effective radius of the "drive row" of the cone. The effective radius of the drive row is generally related to the radial extent of the cutting elements that extend axially the farthest from the axis of rotation of the cone, these cutting elements generally being located on a so-called "drive row". Adding to the complexity of roller cone bit designs, the cutting elements disposed on the cones of the roller cone bit deform the earth formation by a combination of compressive fracturing and shearing. Additionally, most modern roller cone bit designs have cutting elements arranged on each cone so that cutting elements on adjacent cones intermesh between the adjacent cones, as shown for example in FIG. 3A and further detailed in U.S. Pat. No. 5,372,210 to Harrell. Intermeshing cutting elements on roller cone bits is desired to permit high insert protrusion to achieve competitive rates of penetration while preserving the longevity of the bit. However, intermeshing cutting elements on roller cone bits substantially constrains cutting element layout on the bit, thereby, further complicating the designing of roller cone drill bits.

Because of the complexity of roller cone bit designs, accurate models of roller cone bits have not been widely developed or used to design roller cone bits. Instead, roller cone bits have largely been developed through trial and error. For example, if cutting elements on one cone of a prior art bit are shown to wear down faster that the cutting elements on another cone of the bit, a new bit design might be developed by simply adding more cutting elements to the faster worn cone in hopes of reducing the wear of each cutting element on that cone. Trial and error methods for designing roller cone bits have led to roller cone bits which have an imbalanced distribution of force on the bit. This is especially true for roller cone bits which have cutting elements arranged to intermesh between adjacent cones and a spearpoint on one of the cones.

One example of a prior art bit considered effective in the drilling wells is shown in FIGS. 3A–3D. This drill bit comprises abit body 100 and three roller cones 110 attached thereto, such that each roller cone 110 is able to rotate with respect to the bit body 100 about an axis oblique to the bit body 100. Disposed on each of the cones 110 is a plurality of cutting elements 112 for cutting into an earth formation. The cutting elements are arranged about the surface of each cone in generally circular, concentric rows substantially perpendicular to the axis of rotation of the respective cone as illustrated in FIG. 3C. In FIG. 3A, the profiles of each row of cutting elements on each cone are shown in relation to each other to show the intermeshing of the cutting elements between adjacent cones. In this example, the cutting elements comprise milled steel teeth with hardface coating applied thereon. This type of drill bit is commonly referred to as a "milled tooth" bit.

As is typical for modem milled tooth roller cone bits, the teeth of the bit are arranged in three rows 114*a*, 114*b*, and 114*c* on the first cone 114, two rows 116*a* and 116*b* on the second cone 116, and two rows 118*a* and 118*b* on the third cone 118. As shown in FIG. 3A, the teeth of the bit are arranged on the cones such that at least one row of teeth on each cone intermeshes with a row of teeth on an adjacent cone.

As is typically for milled tooth roller cone bits, the first row of teeth 114*a* on the first cone 114 is located at the apex of the cone to cut formation at the center of the bit, proximal to the bit axis of rotation, as shown in FIG. 3B. This row of teeth located at the apex of the first cone is referred to as the spearpoint of the bit, as described above. To avoid contact with the spearpoint on the first cone, the apexes of the other two cones 116, 118 are truncated.

While roller cone drill bits with spearpoints are generally considered effective in drilling well bores, spearpoints have also been shown to result in large moments on the bit due to the force on the tip of the spearpoint resulting from contact with the formation during drilling. In general, the longer the spearpoint with respect to the other cones, the larger the moment arm and resulting moment. Thus it is desirable to provide a roller cone drill bit which cuts through formation at the center of the bit without the use of a spear point.

BRIEF SUMMARY OF THE INVENTION

The invention comprises a roller cone drill bit for drilling an earth formation. The drill bit includes a bit body and a plurality of roller cones attached to the bit body and able to rotate with respect to the bit body. Each roller cone of the bit includes an truncated apex and a side surface. The drill bit further includes a plurality of cutting elements disposed on the side surface of each cone. The cutting elements on at least one cone are arranged such that at least one cutting element on that cone extends past an axis of rotation of the bit body as the bit is rotated. In one embodiment, the drill bit includes three cones and the cutting elements are arranged on the cones so that cutting elements on adjacent cones intermesh between the cones.

BRIEF DESCRIPTION OF THE DRAWINGS

FIG. 3C is a spacing diagram for a prior art bit.

FIG. 6 is a spacing diagram for a drill bit in accordance with one embodiment of the invention.

DETAILED DESCRIPTION

Figure 4:
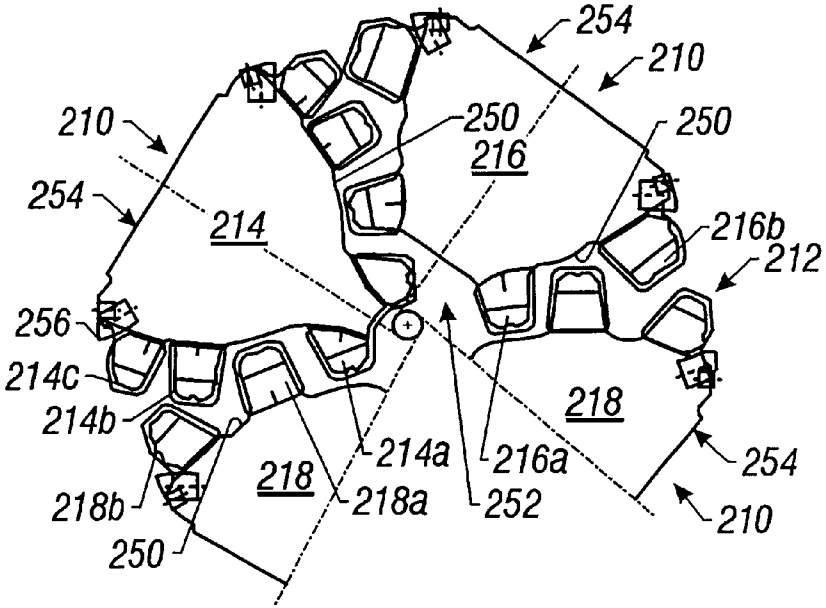
FIG. 4 is a diagram of the roller cones for a bit in accordance with one embodiment of the invention illustrating an intermeshing relationship of the cutting elements between the cones.

Referring to FIGS. 4–7, in one embodiment, the invention comprises a roller cone drill bit which includes a bit body 200 (partial view in FIG. 5) and a plurality of roller cones (typically three), shown generally at 210 in FIG. 4. The roller cones 210 are attached to the bit body 200 and rotatable with respect to the bit body 200. In this embodiment, the cones 210 include a first cone 214, a second cone 216, and a third cone 218. Each cone 214, 216, 218 includes an exterior surface, generally conical in shape. In this embodiment, the exterior surface of each cone 210 includes a side surface 250, an truncated apex 252, and a bottom surface 254, as shown in FIG. 4. In this embodiment, the side surface 250 can be generally defined as the surface of a cone between the truncated apex 252 of the cone and the bottom surface 254 of the cone. The cones 210 are arranged on the bit such that the bottom surface 254 of each cone 210 mates with the bit body 200. The truncated apex 252 of each cone 210 of the bit is configured to remain substantially out of contact with the bottom hole during drilling.

Figure 1:
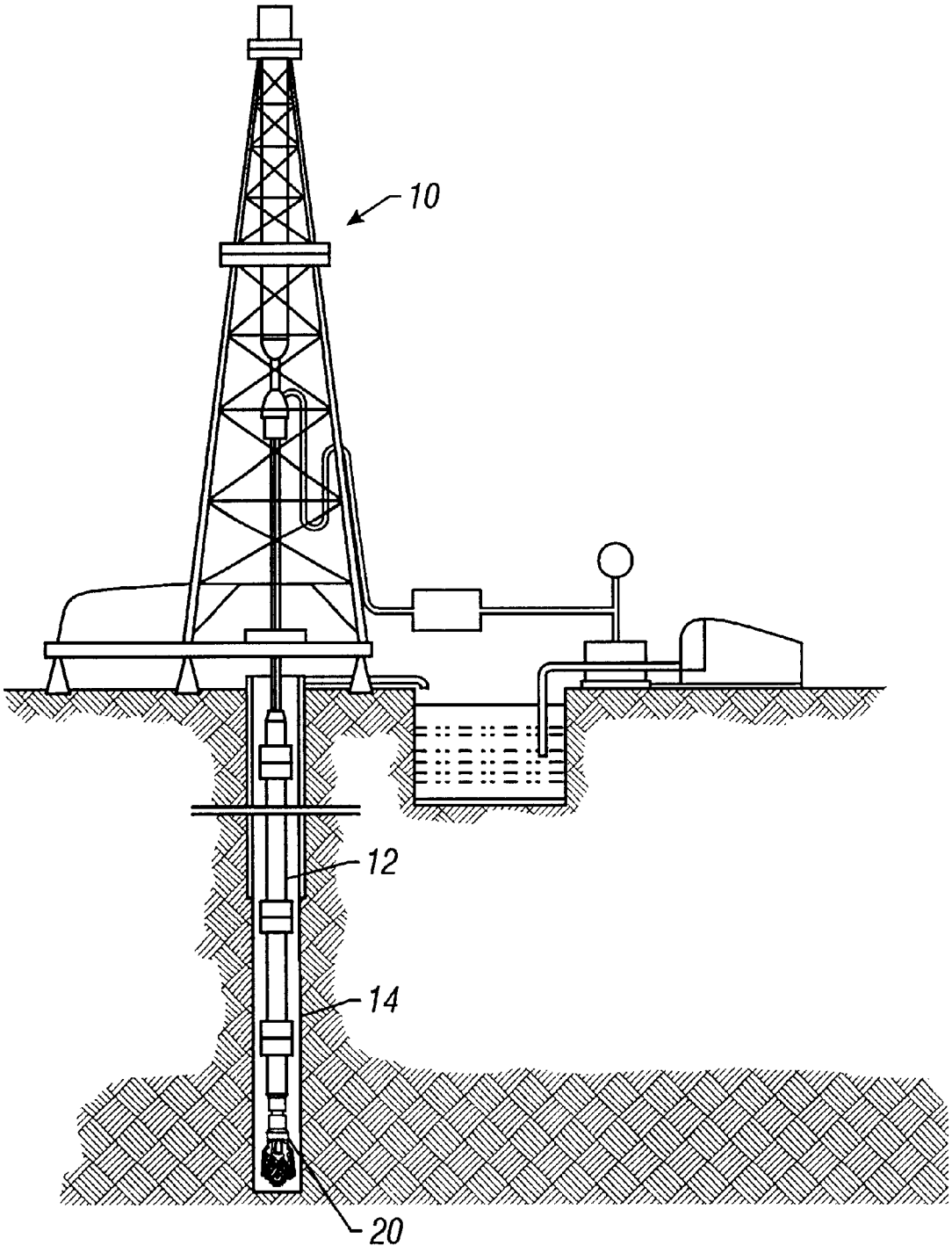
FIG. 1 (Prior Art)
FIG. 1 shows a schematic diagram of a drilling system for drilling earth formations.
Figure 2:
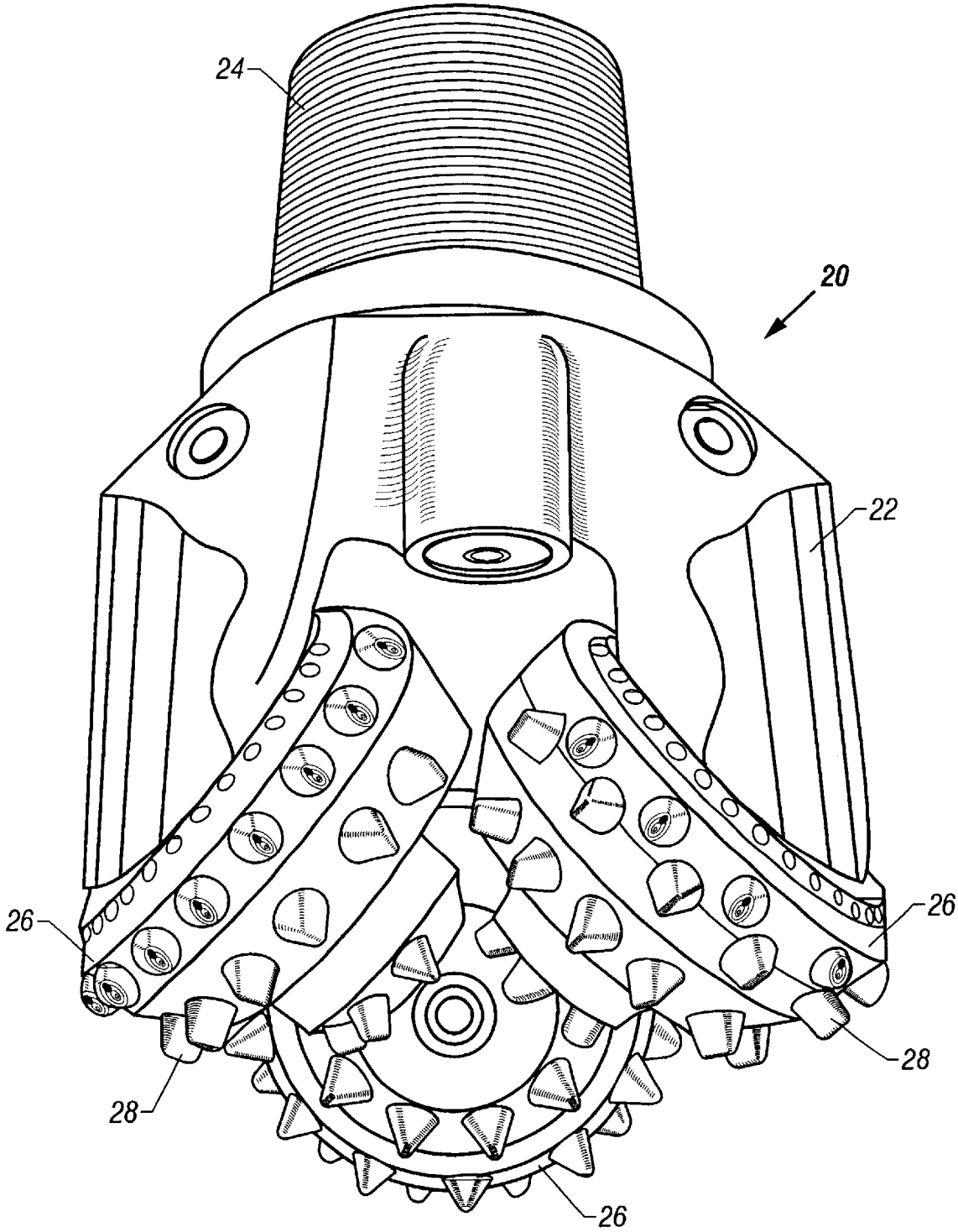
FIG. 2 (Prior Art)
FIG. 2 shows a perspective view of a prior art roller cone drill bit.
Figure 3B:
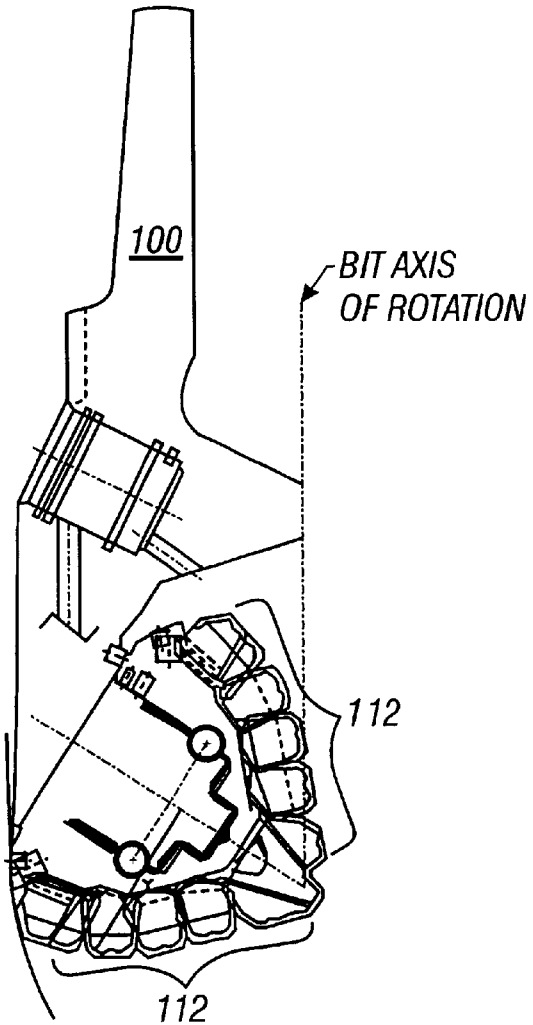
FIG. 3B (Prior Art)
FIG. 3B is a schematic diagram of one leg of a prior art bit wherein the effective position of cutting elements on all three cones of the bit are illustrated on the cone shown to illustrate bottomhole coverage of the bit.
Figure 3A:
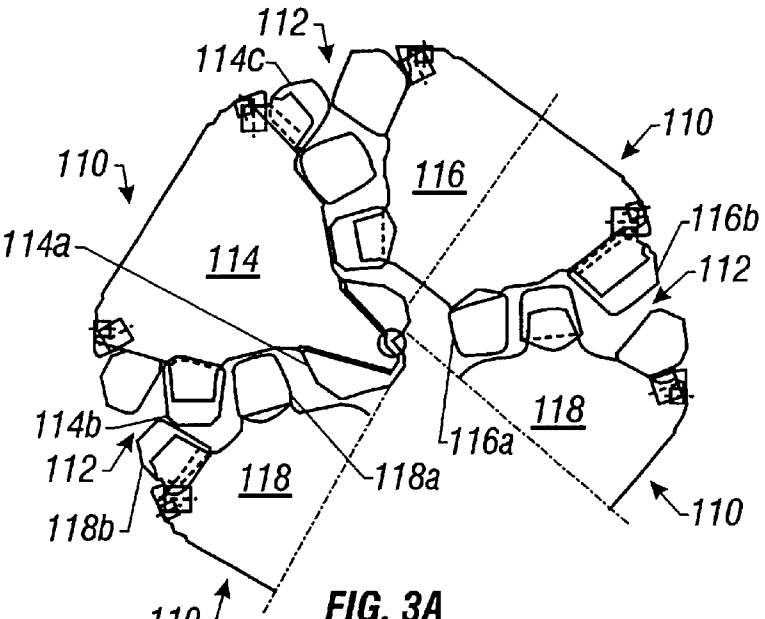
FIG. 3A (Prior Art)
FIG. 3A is a diagram of the roller cones of a prior art drill bit illustrating the intermeshing relationship of the cutting elements between the cones.
Figure 3D:
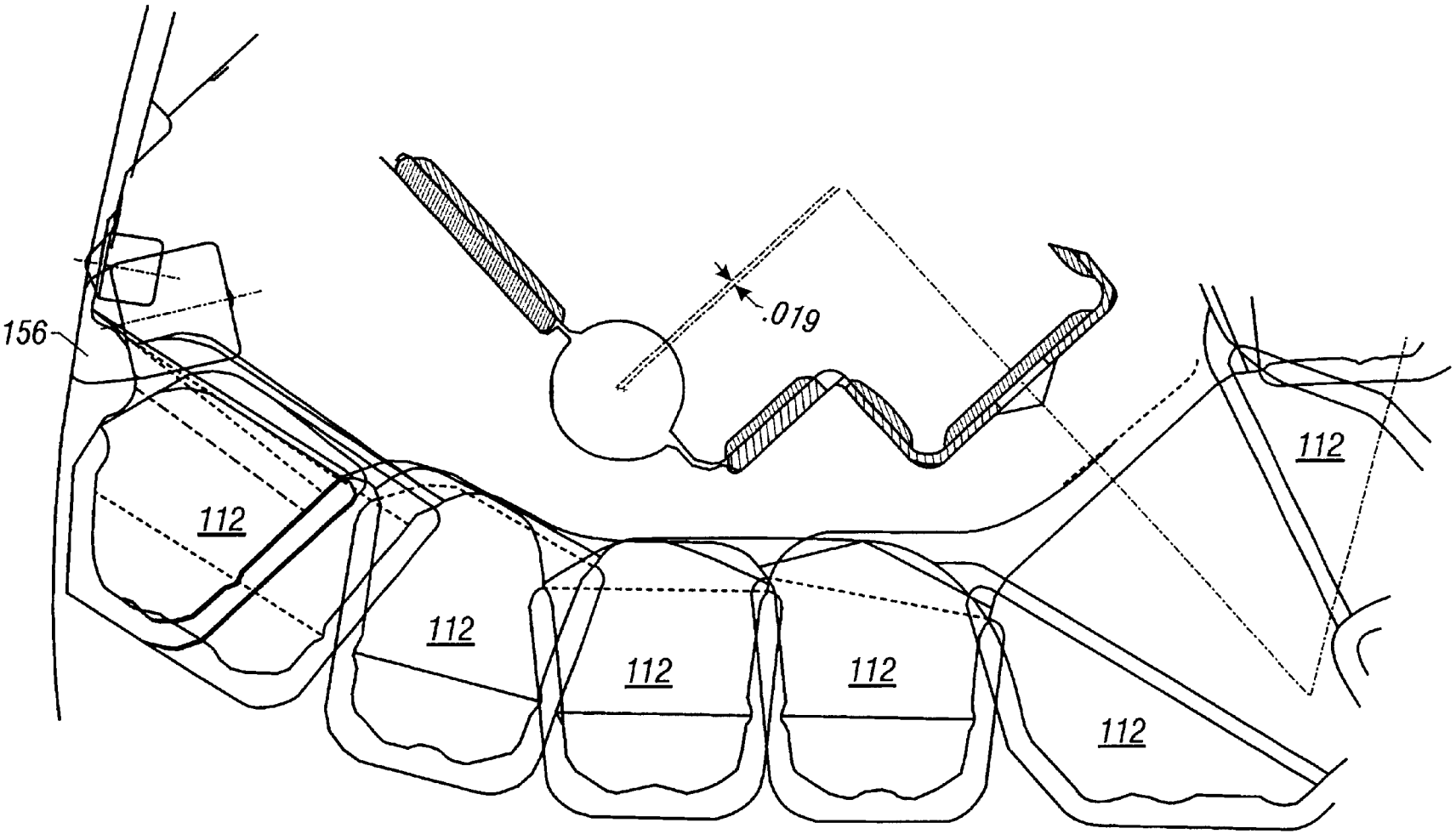
FIG. 3D is an enlarged partial view of the cone and cutting elements of the prior art bit shown in FIG. 3B.
Figure 5:
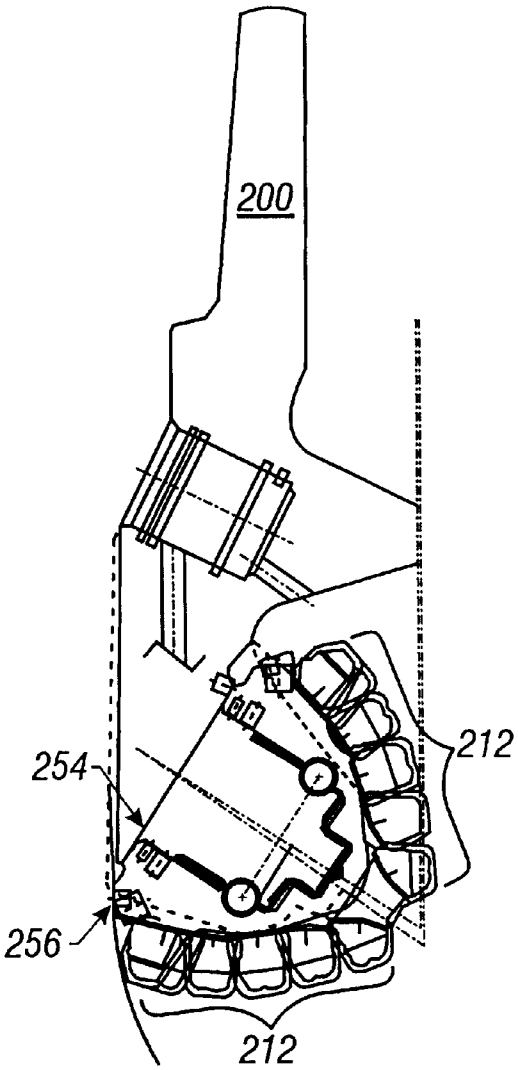
FIG. 5 is a schematic diagram of one leg of a drill bit configured in accordance with one embodiment of the present invention, wherein the effective position of cutting elements on all three cones of the bit are illustrated on the cone shown to illustrate bottomhole coverage of the bit.
Figure 7:
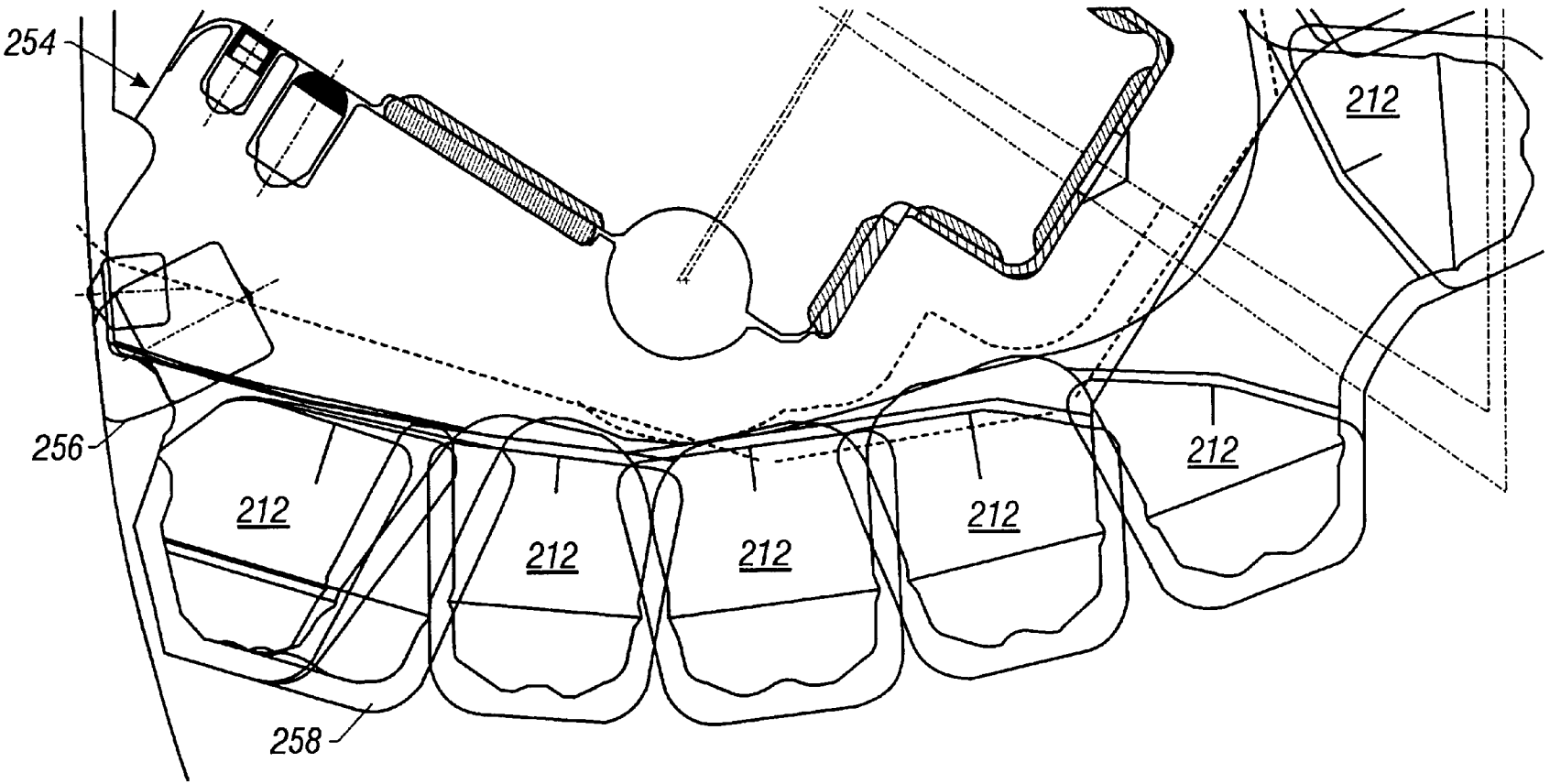
FIG. 7 is an enlarged partial view of the cone and cutting elements for an embodiment of the invention as shown in FIG. 5.

The drill bit further includes a plurality of cutting elements disposed about the side surface 250 of each cone 210, as shown generally at 212 and additionally at 256 in FIGS. 4–5 and 7. In this embodiment, the truncated apex 252 of the cone is substantially free of cutting elements. A distinction between cutting elements 212 and cutting elements 256 will be further explained.

In general terms, at least three different types of cutting elements may be disposed on the cones, including primary cutting elements, generally indicated as 212, gage cutting elements, generally indicated as 256 and ridge cutting elements (not shown). In this embodiment, primary cutting elements 212 are the cutting elements generally arranged about the side surface 250 of the cones to cut through the bottomhole surface of the formation. Primary cutting elements 212 are arranged on each cone such that a number of primary cutting elements 212 on adjacent cones intermesh between the cones. Gage cutting elements 256 are cutting elements which scrape the wall of the well bore to maintain the diameter of the well bore. Gage cutting elements 256 are typically arranged in one or more rows about the lower edge of one or more cones as shown at 256 in FIGS. 4, 5, and 7. Rows of gage cutting elements 256 are typically referred to as "gage" rows, "heel" rows, or "trucut" rows. Ridge cutting elements (not shown) are miniature cutting elements, typically comprising hardened material deposits, that are optionally disposed about the surface of a cone, usually between primary cutting elements 212 to cut ridges of formation which pass between primary cutting elements 212 on the cones. Ridge cutting elements (not shown) are used to reduce damage or wear of the cone surface by reducing contact between the cone surface and the formation.

It should be understood that in a drill bit according to the invention, the cutting elements may comprise only primary cutting elements 212, or primary cutting elements 212, gage cutting elements 256 and, optionally, ridge cutting elements (not shown). Further, while primary cutting elements 212 and gage cutting elements 256 are shown as distinctly different sets of cutting elements in this embodiment, it should be understood that in other embodiments, one or more primary cutting elements 212 may be disposed on one or more cones to essentially perform as a gage cutting element. The types and combinations of cutting elements used in specific embodiments of the invention are matters of choice for the bit designer and are not intended as limitations on the invention.

FIGS. 4 shows cone and cutting element configurations for this embodiment of the invention illustrating the location of the primary cutting elements 212 on each cone. As shown in FIG. 4, primary cutting elements 212 on each cone are arranged such that primary cutting elements 212 on adjacent cones intermesh between the cones.

In this embodiment, the cutting elements comprise milled steel teeth with hardface coating 258 applied thereon (shown in more detail in FIG. 7) to produce a tooth cutting structure with increased hardness. In alternative embodiments, the cutting elements may comprise milled steel teeth without hardface coating, or alternatively, tungsten carbide inserts, superhard inserts, such as boron nitride or polycrystalline diamond compacts, or inserts with other hard coatings or superhard coatings applied there on, as determined by the bit designer.

In this embodiment, the primary cutting elements 212 are generally arranged in circular, concentric rows about the side surface 250 of each cone, as shown in FIGS. 4 and 6. On the first cone 214 the cutting elements 212 are arranged in three rows 214*a*, 214*b* and 214*c*. On the second cone 216 the cutting elements 212 are arranged in two rows 216*a* and 216*b*. On the third cone 218 the cutting elements 212 are arranged in two rows, 218*a* and 218*b*. The cutting elements are arranged so that at least one row of cutting elements on each cone intermeshes with a row of cutting elements on an adjacent cone. In this embodiment, the truncated apex 252 of each cone is substantially free from cutting elements. Instead, each apex is adapted to remain substantially out of contact with the bottom of the borehole being drilled. Thus, to cut formation at the center of the bit, primary cutting elements 212 on the first cone 214 of this embodiment are arranged such that at least one cutting element 212 on the cone 214 extends past the axis of rotation of the bit to cut formation at the center of the bit as the bit is rotated.

It should be understood that the number of the cutting elements shown in FIG. 6 is directed to the number of the primary cutting elements 212 on the cones used to cut the bottomhole surface of the well bore. The number and arrangement of gage cutting elements 256 in this embodiment of the invention are a matter of choice for the bit designer. Additionally, ridge cutting elements may, optionally, be disposed on the cone body as determined by the bit designer. Additionally, it should be understood that all of the primary cutting elements are not required to intermesh between adjacent cones. The actual number of cutting elements that intermesh between the cones and the arrangement of cutting elements on the cones are matters of choice for the bit designer and are not intended as limitations on the invention.

Advantageously, the invention provides a roller cone drill bit which is able to cut formation at the center of the bit without the use of a spearpoint at the apex of a cone. By adapting each apex to remain substantially out of contact with the bottom of the hole being drilled, the resulting moment on the bit during drilling can be reduced and performance and longevity of the bit may be increased. By arranging the cutting elements on the side surfaces of the cones such that one or more cutting elements extend past the axis of rotation of the bit as the bit is rotated, the earth formation at the center of the bit can be cut to avoid the formation of a core in the borehole. Specifically, in the example embodiment shown, the cutting elements of the bit are arranged on the cones, such that the first row 214*a* of cutting elements 212 on the first cone 214 extends past the axis of rotation of the bit to cut formation at the center of the bit 260 (shown, for example, in FIG. 5). In alternative embodiments, cutting elements may be arranged in any number of rows on each of the cones, or the cutting elements may not be arranged in rows, but instead placed in a different configuration about the surface of the cone, such as a staggered arrangement. It should be understood that the invention is not limited to the particular arrangement of the cutting elements shown in FIGS. 4–7, but rather the cutting elements may be arranged in any suitable manner as determined by the bit designer without departing from the spirit of the invention. Further, although a roller cone bit having three cones is shown for this embodiment, it should be understood that the invention is not limited to bits having three roller cones. The invention only requires that the bit have at least three roller cones.

In accordance with the embodiment shown in FIGS. 5 and 7, the at least one cutting element that extends past the axis of rotation when the bit is rotated is positioned to provide a core percentage of about 10 percent or less. Referring to FIG. 7, core percentage may be calculated as the percent ratio of (1) the distance between the axis of rotation and the nearest cutting element when oriented toward the bottom of the borehole to (2) the distance between the axis of rotation and the wall of the borehole.

Using a method for simulating a roller cone bit drilling an earth formation, the drilling performance of a bit in accordance with the embodiment of FIGS. 4–7 was analyzed and found to provide several drilling characteristics which represent improvements over other prior art roller cone drill bits. One such simulation method, for example, is described in a patent application filed in the United States on Mar. 13, 2000, entitled "Method for Simulating the Drilling of Roller Cone Drill Bits and its Application to Roller Cone Drill Bit Design and Performance" and assigned to the assignee of this invention. From the analysis it was shown that the bit in accordance with the present invention, advantageously, resulted in a decrease in the resulting moment on the bit due to the lack of a moment arm on the cone in comparison to other prior art bit, such as the one shown in FIGS. 3A–3D. Minimizing the moment acting on the cone, advantageously, may decrease cone cocking and increase the performance and longevity of the bit. Additionally, it was shown that, elimination of the spearpoint resulted in a more even distribution of force between the cones.

While the preferred embodiment detailed above was found to provide improved drilling characteristics over prior art bits, the invention is not limited to providing improved drilling characteristics, but instead is directed providing a roller cone drill which can cut formation at the center of a bit with out the requirement of a spearpoint.

The invention has been described with respect to preferred embodiments. It will be apparent to those skilled in the art that the foregoing description is only an example of the invention, and that other embodiments of the invention can be devised which will not depart from the spirit of the invention as disclosed herein. Accordingly, the invention shall be limited in scope only by the attached claims.

What is claimed is:

1. A roller cone drill bit, comprising:

a bit body;

a plurality of roller cones attached to the bit body and able to rotate with respect to the bit body, each cone comprising a truncated apex and a side surface;

a plurality of cutting elements disposed on the side surface of each of the cones, the cutting elements being arranged such that at least one of the cutting elements on at least one of the cones extends past an axis of rotation of the bit body as the bit is rotated and defines a core percentage of about 10 percent or less.

2. The drill bit according to claim 1, wherein the plurality of cutting elements on each of the cones is arranged in rows on the side surface of each cone, such that at least one row of the cutting elements on at least one cone extends past the axis of rotation.

3. The drill bit according to claim 1, wherein the cutting elements comprise superhard inserts.

4. The drill bit according to claim 3, wherein superhard inserts comprise boron nitride.

5. The drill bit according to claim 3, wherein the superhard inserts comprise polycrystalline diamond compacts.

6. The drill bit according to claim 1, wherein the cutting elements comprise tungsten carbide inserts.

7. The drill bit according to claim 6, wherein the cutting elements further comprise a superhard material coating.

8. The drill bit according to claim 1, wherein the cutting elements comprise milled steel teeth.

9. The drill bit according to claim 8, wherein the cutting elements further comprise hardface coating.

10. The drill bit according to claim 1, wherein cutting elements on adjacent cones intermesh between the adjacent cones.

11. The drill bit according to claim 8, wherein the plurality of roller cones comprises three roller cones.

12. A roller cone drill bit, comprising:

a bit body;

a plurality of roller cones attached to the bit body and able to rotate with respect to the bit body, each cone comprising a truncated apex and a side surface; and a plurality of cutting elements arranged on the side surface of each of the cones, on one of the cones, the cutting elements being arranged in at least three rows and such that at least one of the cutting elements extends past an axis of rotation of the bit body as the bit is rotated.

13. The drill bit according to claim 12, wherein the plurality of cutting elements on each of the cones is arranged in rows on the side surface of each cone, such that at least one row of the cutting elements on at least one cone extends past the axis of rotation.

14. The drill bit according to claim 12, wherein the cutting elements comprise superhard inserts.

15. The drill bit according to claim 14, wherein superhard inserts comprise boron nitride.

16. The drill bit according to claim 14, wherein the superhard inserts comprise polycrystalline diamond compacts.

17. The drill bit according to claim 12, wherein the cutting elements comprise tungsten carbide inserts.

18. The drill bit according to claim 17, wherein the cutting elements further comprise a superhard material coating.

19. The drill bit according to claim 12, wherein the cutting elements comprise milled steel teeth.

20. The drill bit according to claim 19, wherein the cutting elements further comprise hardface coating.

21. The drill bit of claim 12, wherein cutting elements on adjacent cones intermesh between the adjacent cones.

22. The drill bit of claim 12, wherein the plurality of roller cones comprises three roller cones.

* * * * *